US009591704B2

(12) United States Patent
Dilger et al.

(10) Patent No.: US 9,591,704 B2
(45) Date of Patent: Mar. 7, 2017

(54) CURRENT DEMAND CONTROL OF LIGHTING MODULES

(75) Inventors: Richard Dilger, Munich (DE); Reinhard Lecheler, Neuburg/Donau (DE)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 14/405,414

(22) PCT Filed: Jun. 25, 2012

(86) PCT No.: PCT/EP2012/062271
§ 371 (c)(1),
(2), (4) Date: Dec. 4, 2014

(87) PCT Pub. No.: WO2014/000765
PCT Pub. Date: Jan. 3, 2014

(65) Prior Publication Data
US 2015/0102737 A1 Apr. 16, 2015

(51) Int. Cl.
*H05B 33/08* (2006.01)

(52) U.S. Cl.
CPC ..... *H05B 33/0815* (2013.01); *H05B 33/0806* (2013.01); *H05B 33/0809* (2013.01); *H05B 33/0821* (2013.01)

(58) Field of Classification Search
CPC ..... H05B 33/0815; H05B 33/0848
USPC ..... 315/186, 297, 307
See application file for complete search history.

(56) References Cited

U.S. PATENT DOCUMENTS

| | | | | |
|---|---|---|---|---|
| 7,262,584 | B2 * | 8/2007 | Crawford et al. | 323/272 |
| 2010/0139423 | A1 * | 6/2010 | Levins, II | B60T 7/104 74/2 |
| 2010/0277088 | A1 * | 11/2010 | Bodano | 315/283 |
| 2011/0204802 | A1 * | 8/2011 | Welten | H05B 33/083 315/193 |
| 2011/0210675 | A1 | 9/2011 | Hamamoto et al. | |
| 2011/0266969 | A1 * | 11/2011 | Ludorf | 315/294 |
| 2012/0032613 | A1 * | 2/2012 | Liu | G09G 3/3406 315/297 |
| 2012/0074875 | A1 | 3/2012 | Rix et al. | |
| 2012/0098442 | A1 | 4/2012 | Jin | |

(Continued)

FOREIGN PATENT DOCUMENTS

| | | | |
|---|---|---|---|
| CN | 102192487 | A | 9/2011 |
| DE | 10051528 | A1 | 5/2002 |

(Continued)

OTHER PUBLICATIONS

International Search Report dated Feb. 15, 2013.
Chinese First Search based on Application No. 2012800742778 (1 page) dated Dec. 12, 2015 (Reference Purpose Only).

*Primary Examiner* — Don Le
(74) *Attorney, Agent, or Firm* — Viering, Jentschura & Partner mbB

(57) ABSTRACT

Various embodiments may relate to a lighting system including a Power Supply Unit and at least one Light Engine Module, with an interface between the Light Engine Modules and the Power Supply Unit. The Light Engine Modules send pulses representing their current demand to the Power Supply Unit adjusting the output current accordingly. The Light Engine Modules are connected in parallel, and the pulse sequences are sent at the same time. Measures are taken to cope with interfered pulses.

15 Claims, 17 Drawing Sheets

(56) References Cited

U.S. PATENT DOCUMENTS

| | | | | |
|---|---|---|---|---|
| 2012/0133299 | A1* | 5/2012 | Capodivacca | H05B 33/0857 315/297 |
| 2012/0139423 | A1* | 6/2012 | Angelin et al. | 315/127 |
| 2012/0223649 | A1* | 9/2012 | Saes | H05B 33/083 315/186 |
| 2013/0250215 | A1 | 9/2013 | Sasaki et al. | |
| 2014/0191684 | A1* | 7/2014 | Valois | 315/307 |
| 2014/0225506 | A1* | 8/2014 | Hasegawa et al. | 315/113 |
| 2015/0042237 | A1* | 2/2015 | Huber | 315/210 |

FOREIGN PATENT DOCUMENTS

| | | | |
|---|---|---|---|
| DE | 102008056188 | A1 | 5/2010 |
| DE | 102011087658 | A1 | 6/2013 |
| EP | 2437579 | A2 | 4/2012 |
| WO | 2012077309 | A1 | 6/2012 |

* cited by examiner

CURRENT DEMAND CONTROL OF LIGHTING MODULES

RELATED APPLICATIONS

The present application is a national stage entry according to 35 U.S.C. §371 of PCT application No.: PCT/EP2012/062271 filed on Jun. 25, 2012, and is incorporated herein by reference in its entirety.

TECHNICAL FIELD

Various embodiments may relate to the field of Solid State Lighting, and describes an interface for a Light Engine Module to its Power Supply Unit and the Light Engine Module respective the Power supply unit. Various embodiments generally relate to a Power Supply Unit for driving one or more.

Light Engine Modules, in particular Light Engine Modules with light-emitting diode (LED) light sources, and a lighting unit including a Power Supply Unit and at least one Light Engine Module. More particularly, various inventive methods and apparatus disclosed herein relate to a self-adjusting Power Supply Unit for driving one or more Light Engine Modules with light-emitting diode (LED) light sources, and an LED-based lighting unit including a self-adjusting Power Supply Unit and at least one Light Engine Module.

BACKGROUND

Illumination devices based on semiconductor light sources, such as light-emitting diodes (LEDs), offer a viable alternative to traditional fluorescent, HID, and incandescent lamps. Functional advantages and benefits of LEDs include high energy conversion and optical efficiency, longer expected lifetime, lower operating costs, and many others. In some applications, an LED-based lighting unit may include a Power Supply Unit which supplies an LED driving current to a plurality of Light Engine Modules, each including one or more LEDs. For example, an Light Engine Module may include a circuit board (e.g., a printed circuit board) having one or more LEDs mounted thereon. Such circuit boards may be plugged into slots in a lighting fixture, or a motherboard, on which the Power Supply Unit may be provided. In various applications and installations, an LED-based lighting unit may include different numbers of LEDs and/or Light Engine Modules. For example, the number of LEDs and Light Engine Modules may be changed depending on the light output requirements, e.g. lumens, for a particular installation.

In general, the magnitude or level of the LED driving current output by a Power Supply Unit will need to be changed according to the number of LEDs and Light Engine Modules to which it is connected and which it drives. This means that if a single Power Supply Unit is going to be employed in a variety of LED-based lighting units with different numbers of LEDs and/or Light Engine Modules, then the Power Supply Unit will have to include a means or provision for adjusting the LED driving current to match the current driving requirements for the different Light Engine Modules according to the different numbers of light sources that they include. Meanwhile, the number of LEDs and Light Engine Modules to be included in a particular LED-based lighting unit is determined at the time of manufacturing that LED lighting unit. Thus, if the same Power Supply Unit is to be employed in a variety of LED lighting units with different numbers of Light Engine Modules, then the power supply unit would have to be programmed at the time of manufacturing for each different LED lighting unit so that its output LED driving current is appropriate for the particular number of Light Engine Modules that are included in that LED lighting unit.

This problem has been addressed by means of interfacing between Power Supply Unit and Light Engine Module. Interfacing means that the Light Engine Module provides the Power Supply Unit with some information, regarding its needed current to fulfill flux, specification and/or its working temperature, in order to reduce the supplied current level when a certain limit is exceeded. There are several ways in the Art to interchange this information between the Light Engine Module and the Power Supply Unit. Buses can be used to interchange such information. Known in the art are analog buses like the 0 . . . 10V bus or digital buses like the DALI (Digital Addressable Light Interface) bus. Also known in the Art are simple Resistor networks that can be measured by the Power Supply Unit and tell the Power Supply Unit the current requirements of the Light Engine Modules. DE 100 51 528 discloses such an interface where a specific Resistor is connected between a third wire and the negative supply line. If several Light Engine Modules are connected to one Power Supply Unit, the resistors are connected in parallel or serial, so a sum signal is given into the Power Supply Unit to define the current requirements. The German patent application 102011087658.8 discloses also resistors to define the current requirement of each Light Engine Module. The bus solutions have the disadvantage of two extra wires needed. The resistor solutions only need one extra wire, but the evaluation of the resistor network and the current adjustment can be very complex.

Since complete Power Supply Unit and Light Engine Module systems have appeared on the market, different companies have tried to fix a way to make the two parts communicate; also some digital protocols have been used for the more complex and high-end systems, but this latter technique is out of the present disclosure's background, and have to be considered apart.

For instance, the company OSRAM has already proposed a three extra-wire interface, able to supply also power to an active Light Engine Module onboard circuitry which provides thermal derating. In this interface type a Light Engine Module onboard resistor forms a divider with a Power Supply Unit pull-up resistor, in order to develop a voltage which sets the Power Supply Unit output current. An operational amplifier on the Light Engine Module then starts to limit this voltage (so reduces the current) when the module overheats.

The company Philips has proposed a different extra-three wire interface, where one wire is connected to the current setting resistor, while another one is connected to a temperature sensing resistor, and the derating is done by the Power Supply Unit itself, not involving any active part on the Light Engine Module.

Both interfaces include a third extra wire for the common signal ground return, and use a voltage developed by the Light Engine Module resistor to set the current, in such a way that the greater voltage causes the greater output current.

Recently, the company OSRAM has come out with a slightly different interface, that actually is a 0 . . . 10 V one customized with a precise current source in the Power Supply Unit to enable the Light Engine Module to use just a resistor to set the current.

Now a new request rises from the market, i.e. the capability of paralleling different modules to be supplied by the same Power Supply Unit. Obviously the Power Supply Unit's outputted current must be the sum of each Light Engine Module nominal value, and the thermal derating capability must be kept even for a multiple Light Engine Module arrangement.

As well, the market is asking for a cost cut, actually pointing to a wire number reduction. Bus-based interfaces normally need 4 wires, two for the power supply of the Light Engine Modules and two for the bus.

So a couple of new features to satisfy the needs have been postulated:

- Multiple modules must be allowed to be connected in parallel using the same interface (of course the different modules are supposed to be identical, or at least to have the same string voltage).
- The setting interface must have a reduced number of wires, and must be as simple as possible in order to reduce costs, especially at the Light Engine Module side.

All the known interfaces proposed up to now are not able to support multiple Light Engine Module connections, a new interface is proposed in order to fulfil all the newest requirements.

SUMMARY

In various embodiments, the way to provide the current requirement information is digital, i.e. by pulses sent by the onboard circuitry of the Light Engine Module: these pulses are then recognized by the Power Supply Unit which adjusts its output current as demanded.

Hereafter both a concept and a possible implementation of a "one wire" analog interface are proposed, with "one wire" meaning that only one extra wire is need besides the two power wires.

Various embodiments relate to a Light Engine Module including:

- a plurality of series connected LEDs
- a positive power supply line
- a common ground line
- a communication line where signals on the communication line are measured against the common ground line,
- a pulse generation Unit generating pulses with its number proportional to the current demand of the Light Engine Module.

In a preferred embodiment the Pulse Generation Unit (PGU) further includes a pulse resistor or diode and a switch. This leads to an easy and cheap circuit in the Light Engine Modules.

In another embodiment the Pulse Generation Unit is capable of measuring different voltages on the communication line. This leads to the capability of the Light Engine Module to distinguish if a pulse sent by itself has also been sent by another Light Engine Module.

Various embodiments also relate to a Power Supply Unit including:

- an output providing electrical power between a positive power supply line and a common ground line,
- a communication line where signals on the communication line are measured against the common ground line,
- an adjustable current generator responsive to an internal measurement signal generating an output current at the output,
- a switchable voltage source coupled to the communication line,
- a measurement unit capable of measuring different voltage levels on the communication line,
- a Central Processing Unit which inputs information from the measurement unit and outputs instructions to the switchable voltage Source and the adjustable current generator.

In another embodiment the measurement unit is capable of distinguishing between three different voltages on the communication line. This leads to the capability to recognize the pulses and distinguish between pulses sent by a single Light Engine Module and pulses sent by at least two Light Engine Modules.

Various embodiments also relate to a method of driving a Light Engine Module with a Power Supply Unit with the following steps:

- the Power Supply Unit sends a synchronisation signal to the communication line to start a pulse sequence;
- every Light Engine Module sends a number of pulses corresponding to its current demand by shorting the communication line via a resistor;
- the Power Supply Unit counts the pulses on the communication Line by measuring the voltage on the communication line;
- the Power Supply Unit adjusts the adjustable current source in respect to the counted pulses.

In another embodiment a pulse pause is situated after every pulse. This leads to an easier implementation in a Microcontroller because the pulses are easier to recognize. In a further embodiment the pulse sequence is long compared to the number of pulses sent. This minimizes the probability of pulse collisions.

In a still further embodiment every pulse sequence has a predetermined number of pulses where every pulse has a place within the pulse sequence. This leads to an easier implementation in a Microcontroller because the pulses are easier to recognize.

In another embodiment a stop signal is sent by the Power Supply Unit after every pulse sequence. This also eases the handling by the Power Supply Unit.

In a still further embodiment the initial pulse distribution of the pulse sequence sent by the Light Engine Modules is generated by random. This leads to a statistical distribution of the recognized pulses.

In a further embodiment the Light Engine Module is capable of measuring a collision event when more than one Light Engine Module sends a pulse at the same time. This is useful to avoid pulse collisions.

In a still further embodiment the Light Engine Module erases the pulse at the place where the collision event occurred and displaces it to another place within the sequence by random. This is a safe method to prevent collisions.

In another embodiment the measurement unit of the Power Supply Unit is capable of measuring a collision event when more than one Light Engine Module sends a pulse at the same time. This is a measure that the Power Supply Unit can count the pulses.

In a further embodiment the central processing unit of the Power Supply Unit counts the pulses and the collision events, adds them together to the recognized pulses, calculates a corrected value with this recognized pulses and a collision density, and adjusts the adjustable current source according to the corrected value. This leads to a reduced error in regard to only counting the pulses.

In a further embodiment the corrected value is calculated by multiplying the recognized pulses with a factor calculated with the collision density raised to the power of itself. This helps to reduce the error.

In a further embodiment the corrected value is calculated according to the formula:

$$\text{correctedvalue}=\text{recognizedpulses}\cdot(1+k)^{(1+k)}.$$

This formula is capable of reducing the error significantly.

In another embodiment the voltage of the communication line is measured against common ground. This eases the construction of the circuit.

Various embodiments also relate to a lighting system, including:

a Power Supply Unit;

at least one Light Engine Module;

wherein the Power Supply Unit and the Light Engine Module have an interface interchanging information and conducting the above mentioned method.

In a preferred embodiment all Light Engine Modules are connected in parallel.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

In the following, several embodiments of the inventive concept will be described. The inventive concept always deals with a three wire interface, where several Light Engine Modules can be connected in parallel to a Power Supply Unit and the current requirements of every Light Engine Module match.

First Embodiment: Analog Circuit

Figure 1:
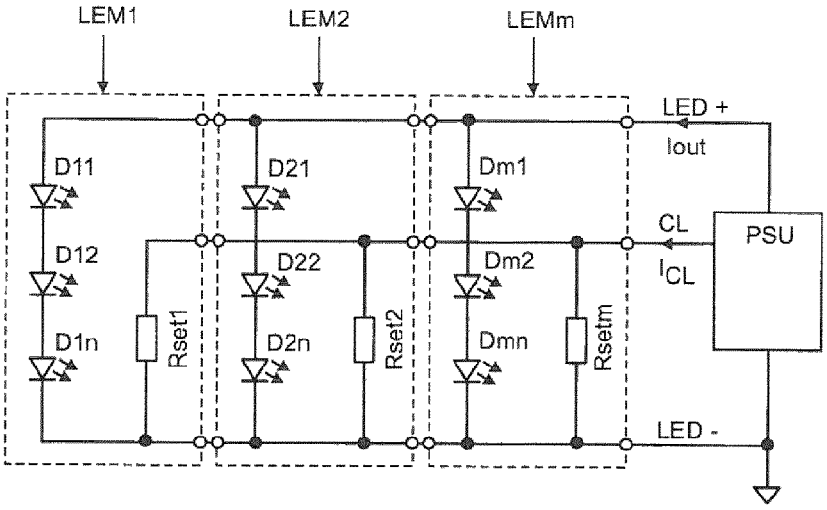
FIG. 1 shows the paralleling concept of current set resistors.

The basic idea of having a resistor to set the current has been kept, but the inventive concept of using it is different. FIG. 1 shows the general paralleling concept of current set resistors. Three Light Engine Modules LEM connected to a Power Supply Unit PSU are shown. The connection consists of three lines; A supply line LED+, a common ground line LED− and a communication line CL. Each Light Engine Module contains at least one LED string. The LED string consists of a plurality of LEDs. A plurality in the light of the present disclosure means that there are at least three LEDs connected in series. Each Light Engine Module also contains a current set Resistor Rset. The current set Resistors are connected between the common ground line LED−and the communication line CL. This leads to a parallel connection of each current set Resistor Rset1, Rset2, Rsetm, so the Power Supply Unit PSU measures the equivalent resistance of that parallel connection. The concept is to have the Power Supply Unit PSU reading not a voltage as in the related art, but a current representative for the resistance value. Then an inverse law is applied to the resistance value to set the Power Supply Unit's output current. The law is as follows:

$$Ioutput = \frac{Kv}{Rset}$$

Kv has the dimension of a voltage.

By doing so, the Power Supply Unit's output current is inversely proportional to the Light Engine Module current set resistor value Rset, i.e. the smaller the resistance, the higher the output current of the Power Supply Unit PSU. This intrinsically satisfies the requirement of having a final current equal to the sum of each single Light Engine Module one, according to the well known Ohm's law.

Figure 2:
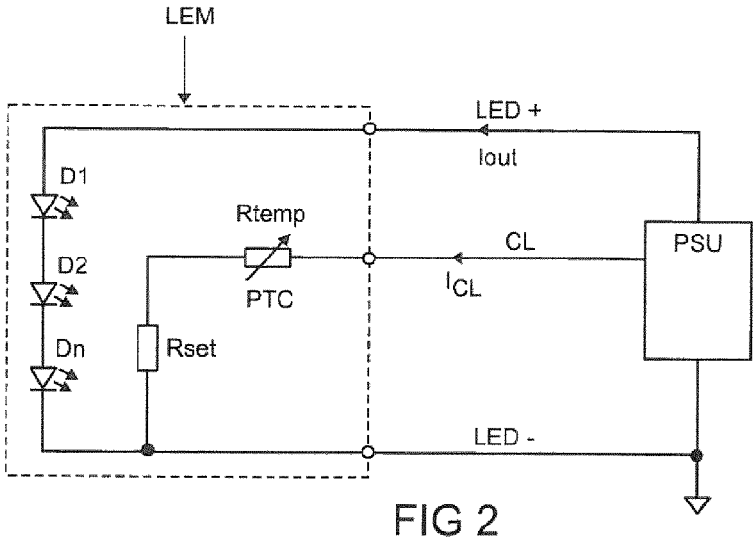
FIG. 2 shows a simple solution for thermal derating.

FIG. 2 shows a concept schematic of an interface with a thermal derating capability. This adds a very simple thermal derating by putting a PTC element in series with Rset. As the temperature of the Light Engine Module LEM rises, the value of the PTC also rises leading to a smaller current for that module. The disadvantage of such an arrangement is that it won't be adequate for a multiple Light Engine Module connection, because a single PTC action would take away from the sum of the parallel connected resistors Rset only that member's contribute, and this could be not enough to reduce the suffering Light Engine Module's temperature enough. Anyhow this solution could be kept for very low-cost applications, when a partial current reduction in the event of overheating is still acceptable.

Figure 3:
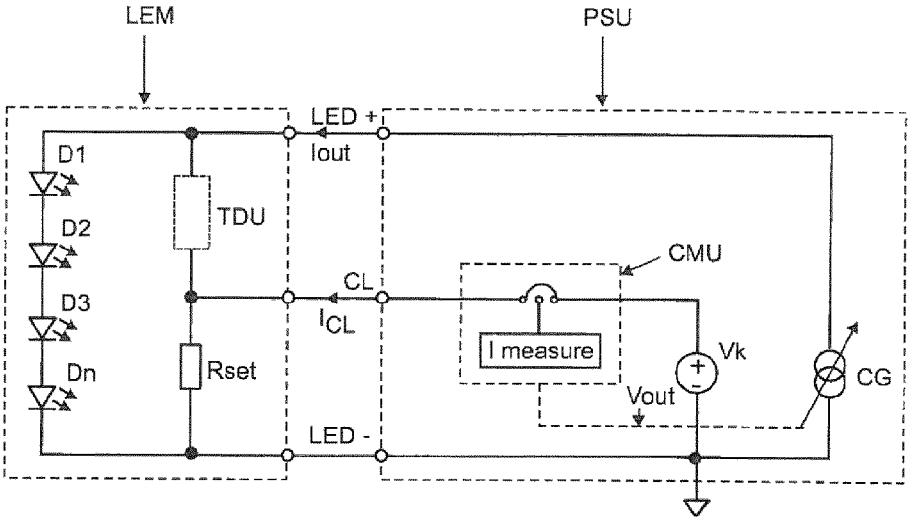
FIG. 3 shows the complete concept of the present disclosure with the thermal derating unit TDU.

Furthermore, a simple temperature element in series with the current setting resistor has the disadvantage of continuously derating the current, without having a precise starting point for the derating itself (even if some PTC elements have a very steep behaviour around the trigger temperature). So the "nominal" current setting would be corrupted by a "parasitic" effect of the derating element. FIG. 3 shows the inventive concept of an interface with a thermal derating unit TDU.

The concept relies on a different approach, by adding an extra current generator TDU onboard the Light Engine Module. This current generator is temperature controlled by a sensing element, and takes power directly from the Light Engine Module's power line, in order to avoid extra wires for the interface. The current generator includes a temperature sensitive resistor generating an input current and an amplifier amplifying that input current to the generated current $I_{TDU}$. The generator is arranged with a threshold which inhibits any current injection until a certain over-temperature of the Light Engine Module is achieved. Then the slope of current versus temperature (gain of $I_{TDU}$) is high enough for the system to try to stabilize the max working temperature of the Light Engine Module, but not so to trigger instabilities due to heat transmission time lags. The current generator is able to override completely the signal generated by the paralleled resistors Rset: in such a way it can safely protect the whole system and especially its own Light Engine Module even in case of multiple Light Engine Module connection together with a very concentrated overheating.

With the temperature dependent current generator a new problem arises. It is necessary to measure Rset independent of the actual temperature of the module and therefore independent of the provided current of the current generator. The way to measure Rset out must be fixed in order to make the action of the current generator predictable.

The present disclosure uses a fixed voltage generator Vk to measure the resistance value, by putting this voltage across the resistor Rset (or their parallel) and then reading the current flowing through it. This in turn makes the current generator TDU directly interacting with the current fixed by Vk on Rset, resolving the final behavioural law.

Figure 4A:
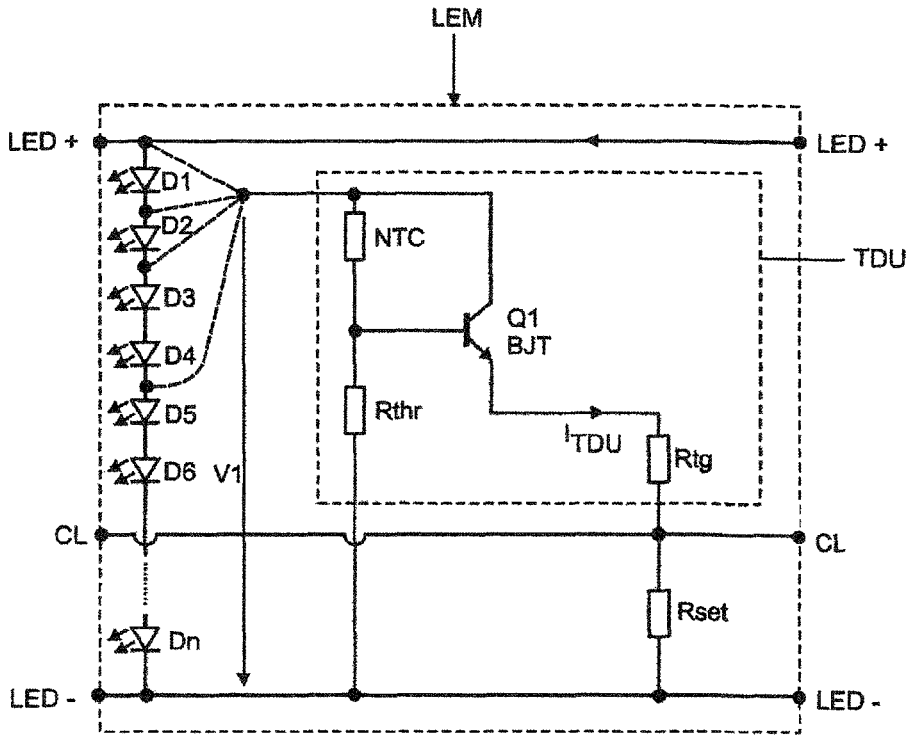
FIGS. 4A and 4B show very simple TDU implementation.

FIG. 4A shows a first embodiment of the Light Engine Module providing the inventive interface, with just one bipolar transistor, an NTC element and a couple of added resistors. The circuit contains a voltage source V1, which is derived from the supply line LED+ of the LED module. LEDs have a quite stable flux voltage, so this can serve as a voltage source "good enough". Dependent of the supply voltage needed for TDU, the voltage source V1, always connected to common ground LED−, can be tapped between a portion of the plurality of series connected LEDs. This means, the voltage V1 can be adjusted in a way that it represents a multiple value of a single LED flux voltage. In parallel to this voltage V1 there is a series connection of the NTC and a threshold resistor Rthr. The base of a NPN Bipolar Junction Transistor (BJT) Q1 is connected to the node between the NTC and Rthr. The collector of Q1 is connected to the voltage V1. The Emitter of Q1 is coupled to the communication line via an emitter resistor Rtg. All these components of FIG. 4A described above are forming the thermal derating unit TDU.

The current set Resistor Rset is connected between the rail-wise positioned CL and common ground LED− lines of the power supply.

In this circuit the potential of Q1's emitter is referred to a forced voltage (by definition Vk) in the Power Supply Unit PSU that realizes the threshold below which no current $I_{TDU}$ is injected into the CL line. When the temperature rises, the NTC starts to raise the base potential, until moving Q1 into the active region. Now the emitter resistor Rtg sets the gain of the circuit TDU, and fixes the slope of the injected current $I_{TDU}$ versus temperature.

The resistor Rthr, together with the NTC at the temperature trigger specified for the TDU, sets the thermal derating starting point in relation to the voltages V1 and Vk.

A further advantage of this arrangement is the good linearity of the current $I_{TDU}$ versus temperature achievable.

One of the most interesting advantages of the present disclosure, besides the easiness of the implementation on the Light Engine Module side, is its capability to be used in different quality grade systems, by adjusting the wanted accuracy and features only by scaling the Power Supply Unit interface's circuitry complexity. In other words it's possible to build the reading interface on the Power Supply Unit side according to the requested accuracy and/or extended features needed.

Figure 4B:
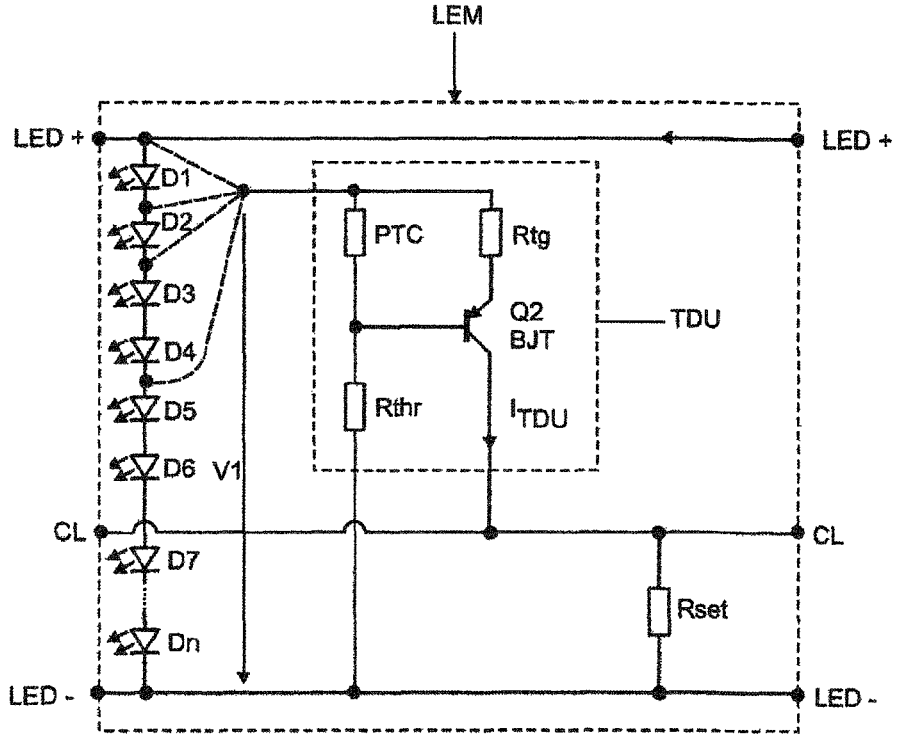

FIG. 4B shows a second embodiment of the Light Engine Module LEM interface with a dual implementation. Here a PNP-Type Transistor Q2 is used together with a PTC. A PTC is a temperature sensitive resistor with a positive temperature coefficient. The voltage V1 is derived from either the whole number of series connected LEDs or a portion of the series connected LEDs. In contrary to the embodiment of FIG. 4A, the collector of Q2 is providing the current source characteristic producing the current $T_{TDU}$, and is connected to CL. Thus the temperature derating threshold is not depending on Vk but only on V1 and the values of the voltage divider formed by the temperature sensitive resistor PTC and the threshold resistor Rthr.

Figure 5:
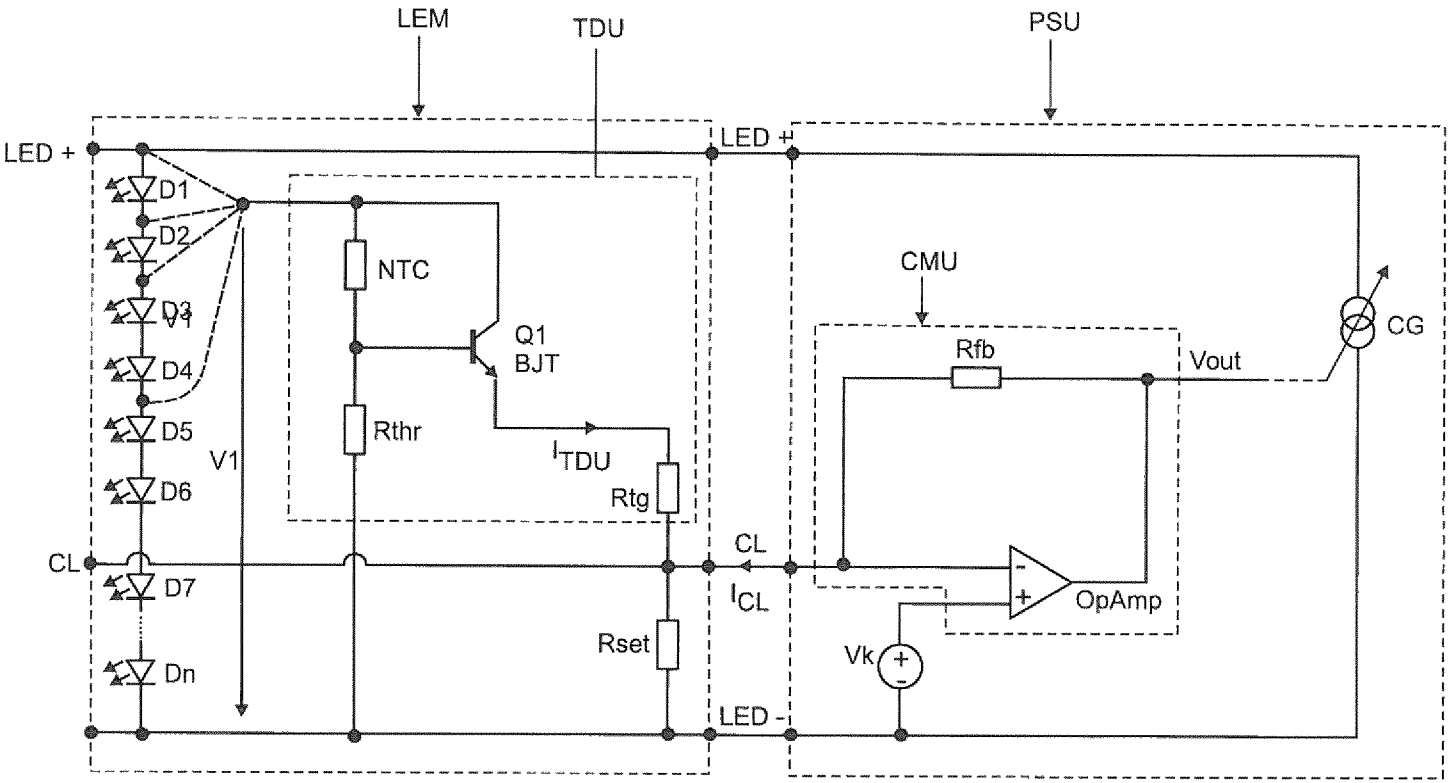
FIG. 5 shows a simple system implementation, $V_{out}$ is the internal voltage representing the output current.

FIG. 5 shows an embodiment of the Power Supply Unit's PSU interface. This is a very simple circuit for cheaper Power Supply Units, where no high accuracy is needed.

Due to the requirement of reduced connection lines and the concept of a common ground line LED−, the problem of voltage drop on that common Ground line LED− due to the Light Engine Module current(s) for the LEDs arises. The embodiment adopts a very simple circuit based on a single operational amplifier, without any compensation of the ground line offset due to the Light Engine Module current. The Power Supply Unit interface includes an operational Amplifier OpAmp, where its negative input is connected to the communication line CL. The output generates an internal measurement signal Vout, which is used to adjust the current Tout provided at the output of the Power Supply Unit. The output of the Power Supply Unit is connected to LED+ and LED− of the Light Engine Module. A current measurement resistor Rfb is connected between the output and the negative input of the operational amplifier OpAmp, thus forming its mandatory negative feedback. A voltage source Vk is connected between the positive input of the operational amplifier OpAmp and the common ground line LED−, thus forming the reference for the PSUs interface.

Actually, just by choosing an adequate value for Vk, the measuring error can be reduced until a reasonable value for the application. For example, stating a 50 mV max voltage drop on the ground path (1 A on a 50 mOhm connection), a 5V voltage is the minimum value for Vk to have an error due to the voltage drop of under 1%.

To achieve a better accuracy, different compensating techniques for that common ground line offset may be applied. One of the most simple is of course to switch-off the Light Engine Module string before to read out Rset: this can be done at the system start-up by a simple machine based on a sample & hold system.

It must be noticed that when the Light Engine Module string is turned off by removing the supply on the LED+ wire, the current level on the communication line CL is not affected by the temperature signal. This is not a disadvantage, because this information is not needed when the Light Engine Modules are completely turned off, rather it is a way to read the Rset value not only with a better accuracy, but also without any deviation due to a possible overheating, respective without any deviation due to the Light Engine Module temperature.

On the other hand, also the opposite way is viable. This means that the pure temperature information is available by simply separating the reference voltage Vk from the OpAmps positive input. Doing so makes the voltage on the third wire be a function of solely the Light Engine Module temperature (the highest one in case of multiple connection), even in case it's lower than the derating threshold. This makes the Power Supply Unit able to derate itself the current to the Light Engine Module(s), according its proper law, and allows to know the working temperature of the Light Engine Module(s) even when not overheated (of course Rset must be known to achieve the best temperature accuracy).

Figure 6:
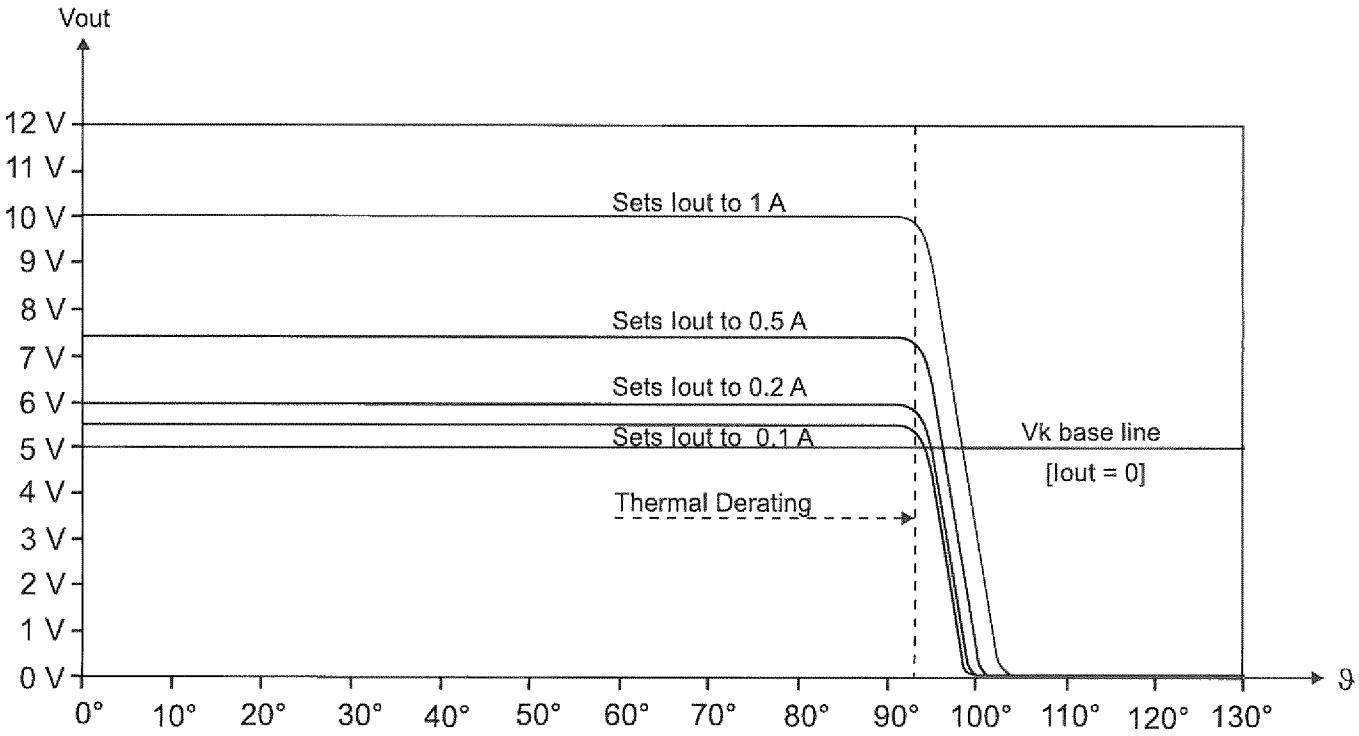
FIG. 6 shows a simulation graph of the circuit of FIG. 5.

FIG. 6 shows a derating curve of the inventive Power Supply Unit. The curve shows the internal control voltage Vout of the Power Supply Unit over the temperature of the Light Engine Module(s). The multiple curves relate to the different current requirements of the connected Light Engine Module(s). It can be seen that the derating starts at a temperature of about 93° C. until about 100° C. to 104° C. the power is shutdown completely.

The function of the inventive interface will be explained in the following with the help of a practical example.

As can be seen in the figure, an output current of 1 A results in an internal measurement signal Vout of 10 V. The interface shall be designed in a way, that a conductance of 1 mS for Rset results in an Output current of 1 A. According to the figure, the voltage source Vk is adjusted to 5 V. This means, that 5V are applied to Rset (see FIG. 5). The operational Amplifier works in a way to minimize the signal Level on its inputs, so it will work until the level at the positive input is the same like the level at the negative input. So if Vk has 5V, this means that 5V will also be at the negative input of the operational amplifier. This leads to 5V at the current set resistor Rset, resulting in a current through the communication line CL of 5 V / 1 kOhm=5 mA. 5 mA through the communication line CL means that these 5 mA also flow through the current measurement resistor Rfb, because the input of the operational amplifier has a high impedance and therefore no current consumption. As the voltage of the internal measurement signal Vout shall be 10 V according to FIG. 6, the voltage over the current measurement resistor Rfb has also to be 5 V resulting in a current measurement resistor Rfb with a value of also 1 kOhm respective 1 mS.

According to this example, a Light Engine Module with a current requirement of 2 A would have a current set resistor Rset of 2 mS, that is 500 Ohms.

Figure 7:
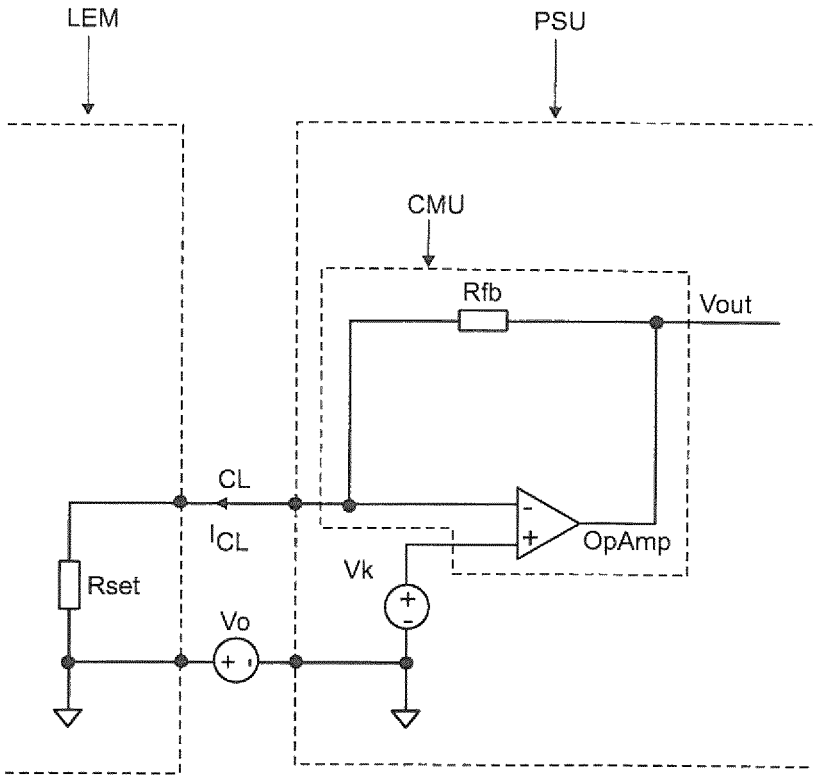
FIG. 7 shows a schematic circuit of how to model the cable voltage drop due to LED current.

As mentioned above, the inventive three wire interface with the concept of the measuring current returning through the common ground line together with the LED current has the disadvantage of corrupting the measuring signal with the voltage drop on the common ground line LED− due to the Light Engine Modules' current flowing through it, but with a proper strategy it is possible to compensate this effect in order to retrieve the true value for the Power Supply Unit. FIG. 7 shows a schematic circuit of how to model the cable voltage drop Vo due to LED current.

The general method to compensate the voltage drop is to vary the Vk voltage of the voltage source in the Power Supply Unit. The voltage drop can be cleared out by a linear equation system based on two different values of Vk, Raising the Vk voltage beyond V1 inside the Light Engine Module makes the Rset value uncorrupted by the temperature information (whichever it could be) without turning off the Light Engine Module power.

As shown in FIG. 7, the voltage drop on the common return LED− can be modelled as a voltage generator Vo in series with Rset: The circuit is similar to the circuit in FIG. 5 with the temperature section left out and added offset generator Vo, which is representing the voltage drop on the cable.

Now the circuit's equation is formulated by simply considering both Op Amp inputs are at the same voltage;

$$\frac{V_{out} - V_k}{R_{fb}} = \frac{V_k - V_o}{R_{set}},$$

or equivalently, $$\frac{R_{set}}{R_{fb}}(V_{out} - V_k) = V_k - V_o. \quad [1]$$

Now, calling $$K_R = \frac{R_{set}}{R_{fb}},$$

we can solve [1] into $V_0$ (constant), and apply two different values for $V_k$ $$\begin{cases} V_o = V_{k,1} - K_R(V_{out,1} - V_{k,1}) \\ V_o = V_{k,2} - K_R(V_{out,2} - V_{k,2}) \end{cases} \quad [2]$$

It is possible to solve this linear system by equation comparison, finally having:

$$V_{k,1} - V_{k,2} = K_R(V_{out,1} - V_{k,1} - V_{out,2} + V_{k,2}) \quad [3]$$

This equation can also be written in terms of differences $\Delta V = V_1 - V_2$ and solved into $K_R$:

$$K_R = \frac{\Delta V_k}{\Delta V_{out} - \Delta V_k} \quad [4]$$

This expresses the ratio between the known and the unknown resistors as a ratio of superimposed (Vk) and measured (Vout) voltage differences.

As can be seen, the voltage drop $V_0$ can be computationally eliminated by two measurements and some mathematics.

Figure 8:
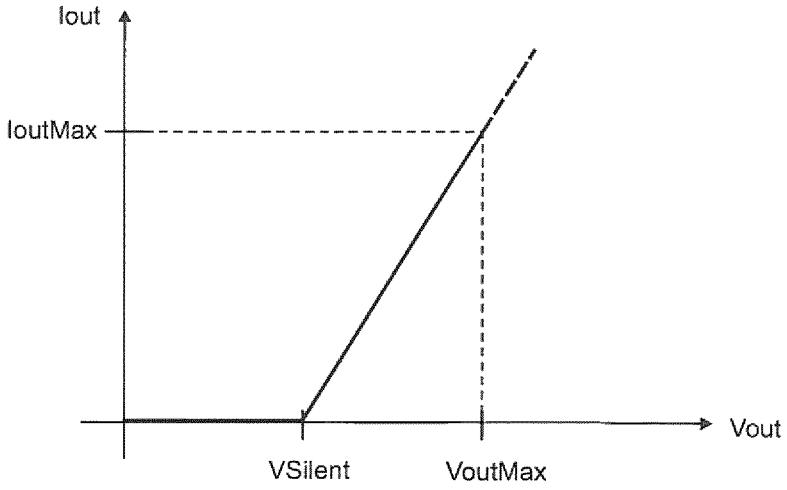
FIG. 8 shows a characteristic of the Current Generator.

FIG. 8 shows a characteristic of the Current Generator according to the example of FIG. 6. The graph shows the input of the Current Generator CG, the internal measurement signal Vout, against the output current of the Current Generator CG Iout. It can be seen, that under a certain voltage, here called Vsilent, no Output current is provided. At the maximum of the internal measurement signal VoutMax, the maximum specified output current of the Current Generator CG is provided. Vsilent is the voltage up to where no current flows on the communication line CL. This can be due to the voltage Vk or due to the Temperature Derating Unit TDU creating a current $I_{TDU}$ similar to the current created by Vk, but in the opposite direction. So this current creates a voltage over Rset similar to VK, therefore no current flows over the communication line CL. Under normal circumstances, a lighting system would be designed in a way that no current is provided by the Current Generator CG if no current flows over the communication line CL. This is because if the condition of a miswiring or a weak contact exists, no power should be provided from the Power Supply Unit PSU to the Light Engine Modules LEM. But under certain circumstances, this provision can be amended.

For normal circumstances, if no power should be provided from the Power Supply Unit PSU to the Light Engine Modules LEM, when no current flows on the communication line CL, the Voltage Vsilent is the same as the Voltage Vk.

Figure 9:
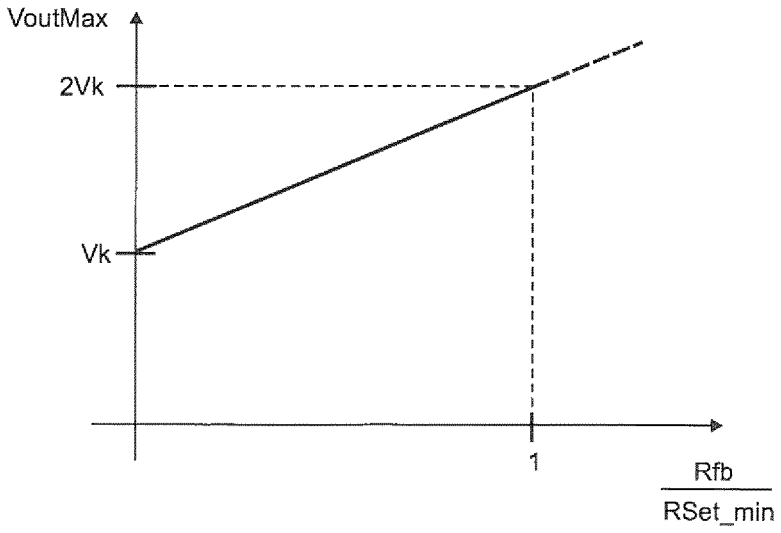
FIG. 9 shows a characteristic of the Current Measurement Unit.

FIG. 9 shows a characteristic of the Current Measurement Unit CMU. A main part of the Current Measurement Unit CMU is the current measurement resistor Rfb. The characteristic shows the output of the Current Measurement Unit CMU, the internal measurement signal Vout, against the normalized current measurement resistor Rfb/RsetMin. RsetMin is the minimal Value leading to the maximal specified output current IoutMax of the Power Supply Unit PSU. So at the value 1, when Rfb=Rsetmin, the Power Supply Unit provides maximal current and Power at its output, and the internal measurement signal Vout is 2*Vk as described in the example of FIG. 6.

Summary:

The inventive interface allows to acquire:

- A composite information from the Light Engine Module, i.e. a nominal current derated by over-temperature, or
- A split information about nominal current and working temperature by properly switching the different generators inside the Power Supply Unit. This of course involves a logic circuit, and it's not as simple as reading a composite, non-compensated value from the communication line CL.
- These are different approaches to read the Light Engine Module communication line CL, but the electronics inside the module stays the same.

These and other advantages of the present disclosure are summarized in the following:

- The inventive interface uses only a simple resistor to set the required current.
- Only one extra wire is required besides the power connection to the Light Engine Modules.
- More Light Engine Modules are allowed to be connected in parallel on the same bus interface.
- The thermal derating can be realised by only adding a simple PTC or four cheap components.
- The auxiliary supply for thermal derating is simply derived from a Light Engine Module string tapping.
- The interface is intrinsically fail-safe, in the sense that, if Rset is broken or the communication line disconnected (the most likely fault events), the output current is switched off.
- In case of short-circuit fault between Light Engine Module+ and the third wire (could be a wrong connection), the output current is intrinsically switched off, so also preserving the interface circuitry itself.
- The Thermal derating unit doesn't drain current from Light Engine Module's supply until Light Engine Module overheating.
- The current used to read out Rset can be varied according to the Power Supply Unit rating, in order to limit its ranging (and improve accuracy) according to the expected applied load.
- The inverse Ohm law allows to keep a constant percentage resolution of output current.
- The accuracy on reading out Rset depends on the complexity of the Power Supply Unit side interface, which can be arranged according to expected system quality grade. Furthermore the reading of Rset may be ratiometric to a reference resistor inside the PSU, without requiring accurate voltage or current sources as in the related art.
- The invented interface may provide different information according the applied stimulus, ranging from a single thermal derated current to two independent and accurate values of nominal current and working temperature.

Second Embodiment: Digital Circuit

First Alternative of the Second Embodiment:

Another solution for the above mentioned problem is a circuit based on a digital design.

Figure 10A:
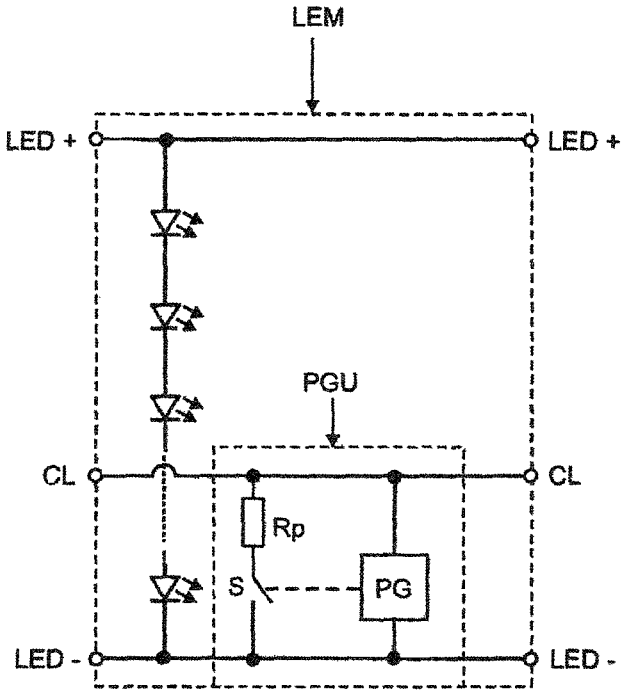
FIG. 10A shows a schematic circuit of a Light Engine Module LEM.
Figure 10B:
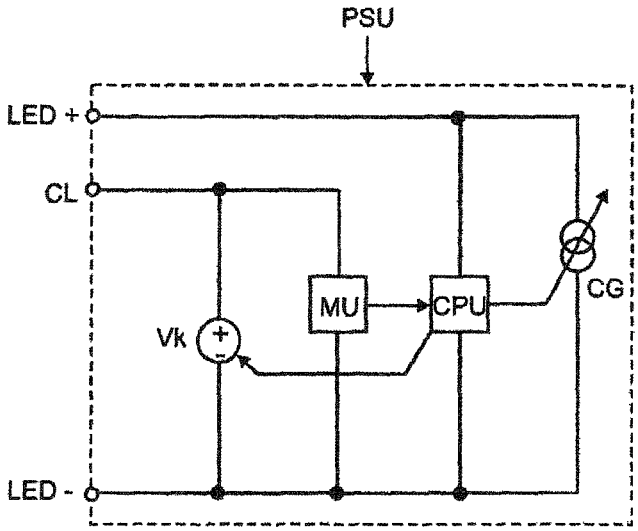
FIG. 10B shows a schematic circuit of a Power Supply Unit PSU.

The circuit itself is shown in FIGS. 10A and 10B: FIG. 10A shows a schematic circuit of a Light Engine Module LEM with a plurality of series connected LEDs and a Pulse Generation Unit PGU. The Pulse Generation Unit PGU includes a series connection of a switch and a resistor between the communication line CL and common ground LED−. The switch is driven by a pulse generator PG. The Pulse generator generates pulses in regard to the current demand of the Light Engine Module. The supply voltage of the pulse Generator PG is derived from the supply voltage for the LED's. The supply voltage also can be taken from the LED string itself by a tapping of the LED string at a desired voltage.

FIG. 10B shows a schematic circuit of a Power Supply Unit PSU delivering the supply current for the Light Engine Modules. The Power Supply Unit has an adjustable voltage source controllable by a Central Processing Unit CPU. The voltage source is connected between common ground LED− and the communication line CL. Parallel to the voltage source is a Measuring Unit MU connected. The Measuring Unit MU measures the voltage on the communication line CL and reports it to the Central Processing Unit CPU. The Central Processing Unit CPU also controls an adjustable Current Generator CG to supply current to the Light Engine Modules. The adjustable Current Generator CG is connected between LED+ and LED−.

Figure 11A:
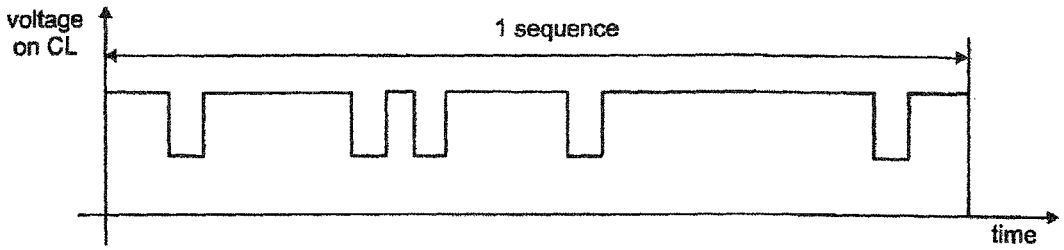
FIGS. 11A to 11C show a sequence of a pulse distribution generated by the Pulse Generation Unit PGU.

FIG. 11A shows a sequence of a pulse distribution generated by the Pulse Generation Unit PGU. The distribution of the pulses of the Pulse Generation Unit PGU of every Light Engine Module is generated by random initially. After this Random generation, the distribution is kept for every new sequence. The inventive method takes place in sequences. A sequence is started by the Power Supply Unit to which the Light Engine Modules are connected. A sequence is started by applying a voltage on the communication Line CL. In every sequence, the pulses are resent by every Light Engine Module LEM to the communication line CL. Several Light Engine Modules LEM can be connected in parallel. Every Light Engine Module LEM has its own pulse distribution. The sequence length of a pulse sequence is very long with respect to the pulses. The sequence length is predetermined. So the probability that pulses overlap is not very high. The pulses have a negative fashion, because they are generated by a current path consisting of the Switch S and the Resistor R. Logic low represents the voltage on the communication line CL as provided by the Power Supply Unit PSU. Logic high represents a fraction of this voltage due to the Resistor Rp in the Pulse Generation Unit and another Resistor sitting in the Power Supply Unit. This leads to a voltage divider and hence the logic high voltage is a fraction of the logic low voltage. Instead of the Resistor Rp a Diode can also be used.

Figure 11B:
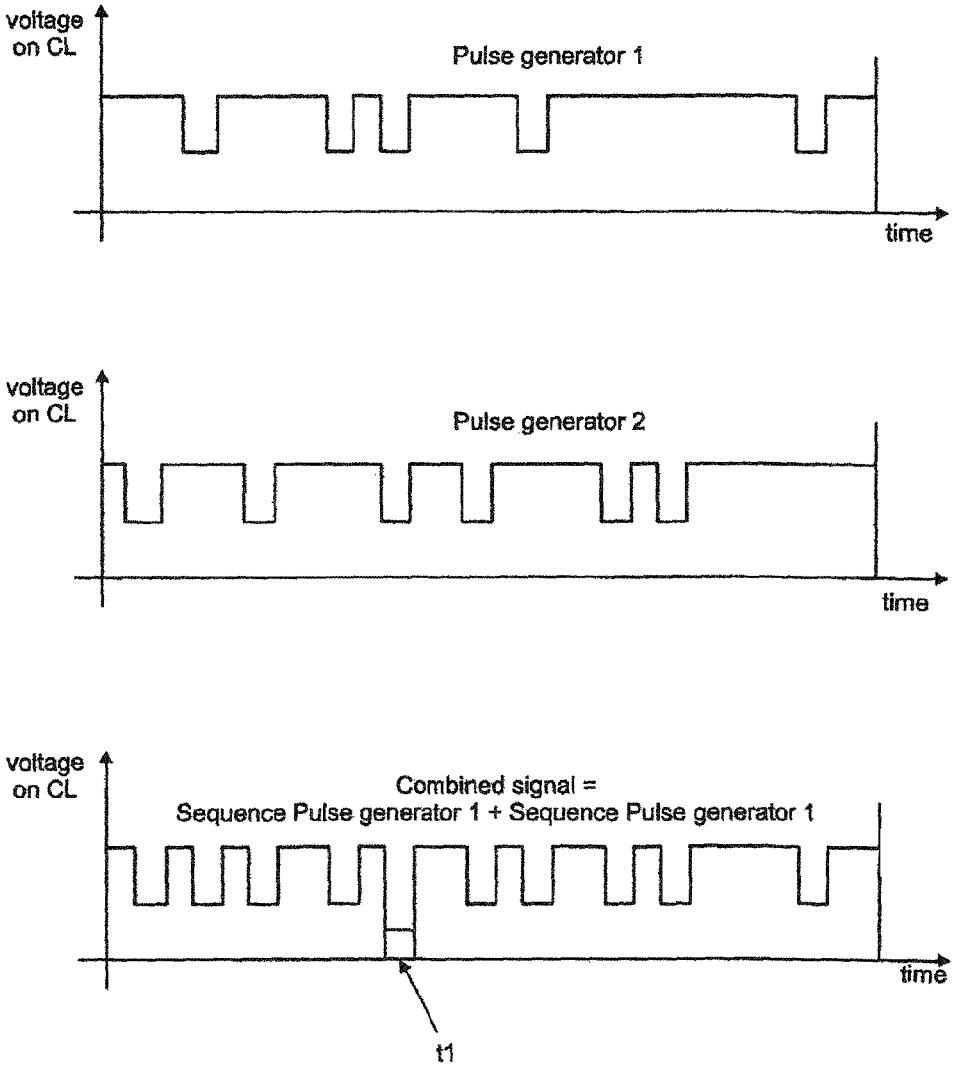
Figure 11C:
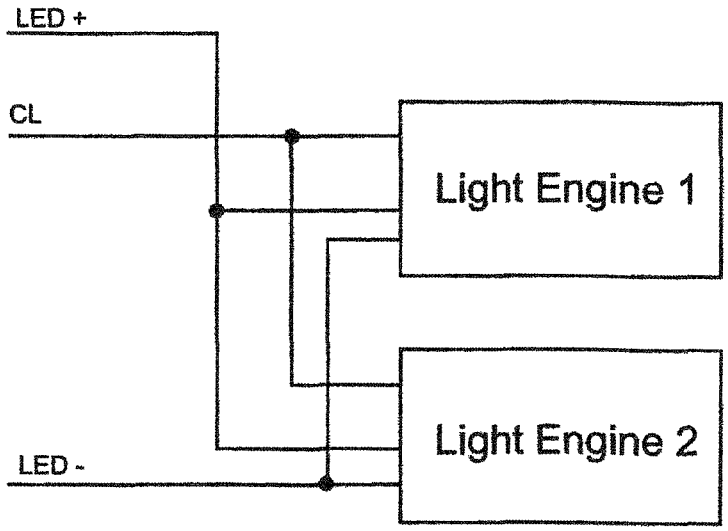

FIG. 11B shows an example of the concept with 2 Light Engine Modules. So there are 2 Pulse Generation Units sending Pulses to the communication line CL, as shown in FIG. 11C. Every Pulse Generator has its own Pulse distribution. The combined distribution as shown in the bottom curve of FIG. 11B has single pulses where only one Pulse Generation Unit creates a pulse. But there is one Pulse at the time t1, where both Pulse Generation Units send a pulse. Due to the Resistor in the path, both resistors of the Pulse Generation Units are connected in parallel. This leads to a different logic high voltage. The voltage can be detected by the Pulse Generation Units registering that a "double pulse event" has occurred. "Double Pulse Event" means, that more than one Light Engine Module sends a pulse at the same time. This can be measured by the voltage on the communication Line CL, because in the case that two Light Engine Modules send at the same time, the two Resistors Rp of the two Light Engine Modules are connected in parallel resulting in a lower overall resistance and therefore a lower voltage on the communication line CL. So "Double Pulse Event" means that a collision of two pulses takes place, therefore a "Double Pulse Event" will also be referred to as collision in the following. If a collision has occurred, the two or more Pulse Generation Units that sent this pulse now cut out this pulse and displaces it to a different location chosen by random. The pulse distribution with the displaced pulse is sent in the next sequence. Then it is very likely that no "double pulse event" happens in the next sequence. If no "double pulse event" occurs any more, every Pulse Generation Unit keeps its present pulse distribution. The pulses are counted by the Power Supply Unit and a current representing the amount of pulses is supplied by the Power Supply Unit.

Every pulse stands for a certain amount of current. For example one pulse can represent for 100 mA of current. So a Light Engine Module with a current demand of 300 mA will send 3 Pulses in every sequence. The upper Pulse Generation Unit in FIG. 11B sends 5 pulses representing a current demand of 500 mA. The second Pulse Generation Unit in FIG. 11B sends six pulses representing a current demand of 600 mA. The Power Supply Unit counts 11 Pulses and delivers a current of 1.1 A. Depending on the pulse density in one sequence, it can take some time until every "double pulse event" is displaced properly so in the end no single "double pulse event" occurs anymore and the proper current is provided by the Power Supply Unit PSU.

Figure 12:
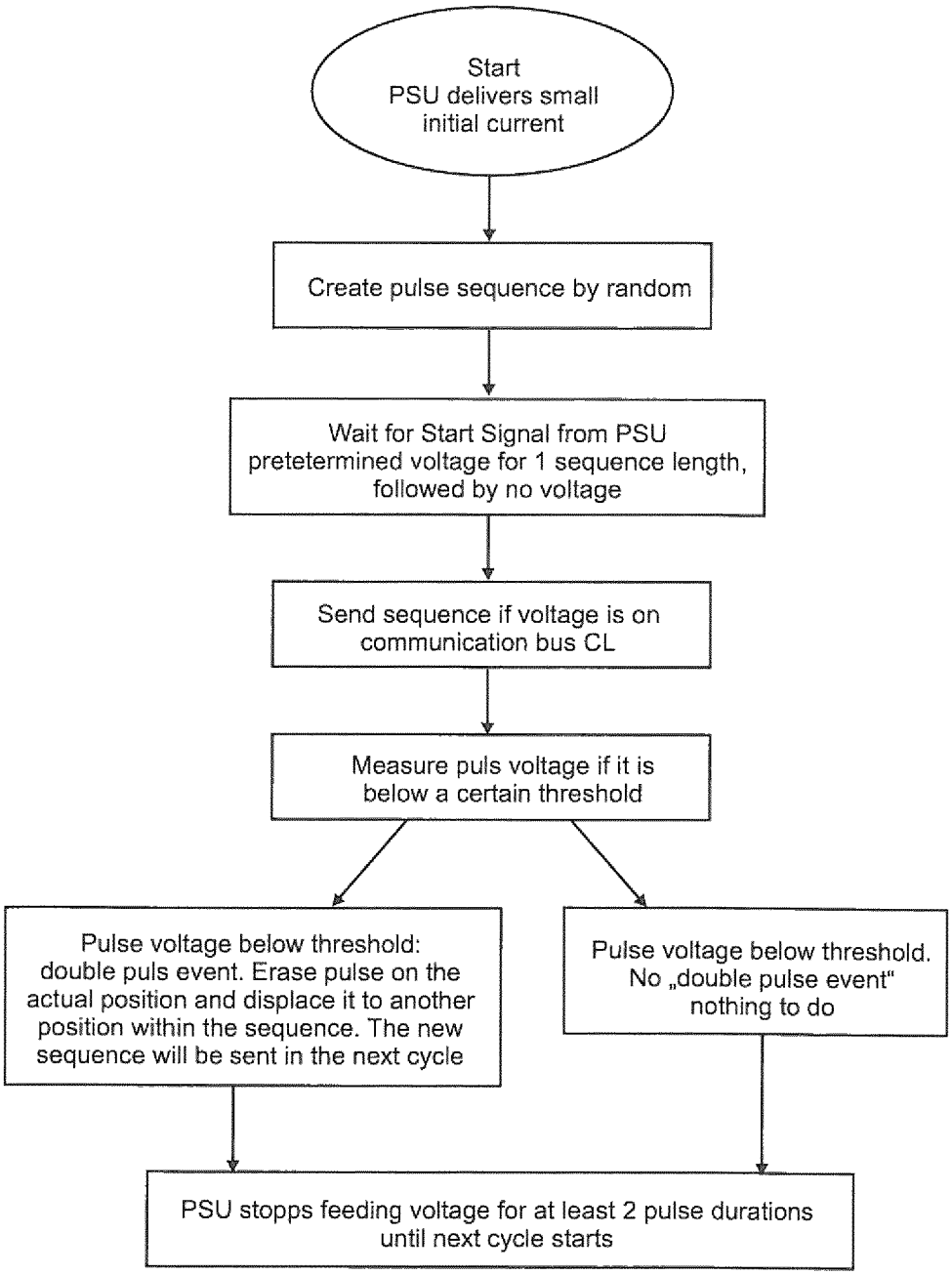
FIG. 12 shows a flow chart of the method the Light Engine Modules carry out.

FIG. 12 shows a flow chart of the method the Light Engine Modules carry out. When a lighting system including a Power Supply Unit and at least one Light Engine Module is switched on, a small initial current is supplied by the Power Supply Unit. The Light Engine Module creates pulse distributions according to their current demand by random and waits for the synchronizing signal from the Power Supply Unit. This signal is a voltage applied on the communication line CL. At the time, the voltage is applied to the communication line CL, every Light Engine Module sends its pulse distribution as a single sequence. All the sequences are sent at the same time. The sequence length is constant. In an exemplary example the pulse length is 100 ms long.

Every pulse is followed by a pulse pause with at least one pulse length. A sequence contains only a predetermined number of pulses. In the example a sequence contains 512 pulses. The Light Engine Module measures every pulse voltage in regard to a predetermined threshold. If the voltage is above this threshold, there is only the own pulse at this place within the sequence, hence there is nothing to do. If the voltage is below the predetermined threshold, more than one Light Engine Module has sent a pulse at this place within the sequence, so every Light Engine Module (that has sent this pulse) erases the pulse at this place and displaces it to another place within the sequence. The new pulse distribution is sent in the sequence of the next cycle. The sequence is stopped at the predetermined time as the Power Supply Unit stops to supply the voltage on the communication line CL. This phase has a duration of at least two pulse lengths. After this, the Power Supply Unit starts a new cycle by applying the voltage to the communication line CL again. In the example, the pulse width can be calculated as the sequence length divided through the maximal pulse number plus the pulse pauses resulting in a pulse width of 98 us. A practicable maximal pulse number of 255 pulses result in a pulse density of maximal 50%. After 5 more sequences, the pulse count is at 90% of the real sent pulses. So it takes about 600 ms to get the light output to 90%.

Figure 13:
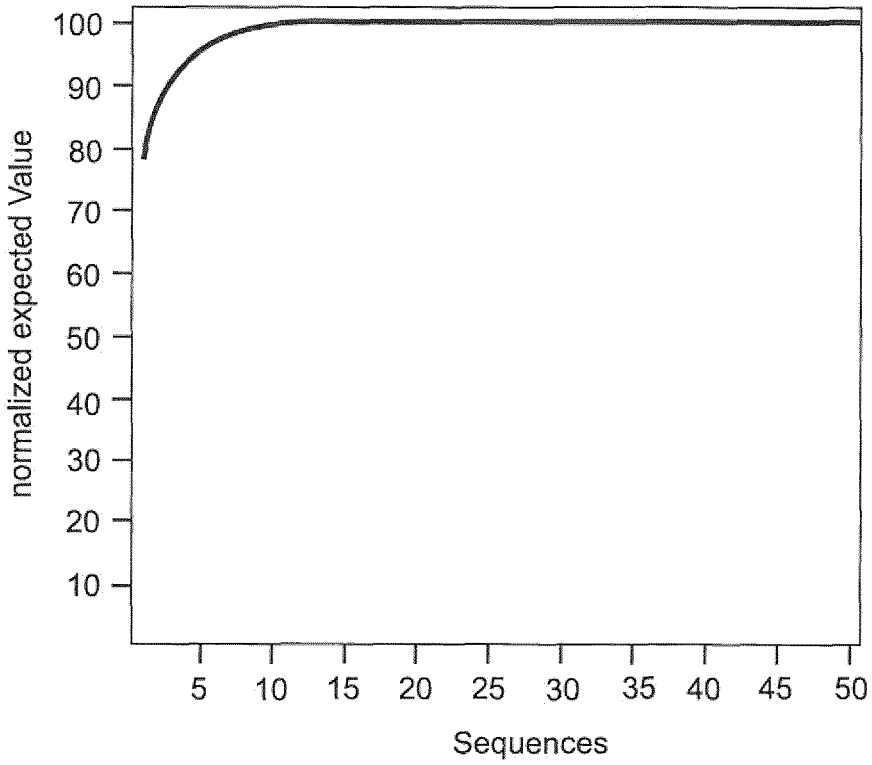
FIG. 13 shows a diagram of the detected pulses by the Power Supply Unit against the pulse sequences at a pulse density of 33%.

FIG. 13 shows a diagram of the normalized detected pulses by the Power Supply Unit against the pulse sequences at a pulse density of 33%. The detected pulses are normalized to the real number of sent pulses and scaled in per cent. The detected pulses are referred to "normalized expected value" in the figure. 100% means that every sent pulse has been detected by the Power Supply Unit PSU. 100% pulse density means that every single place in a sequence is occupied by a pulse. As has been said above, the length of a sequence is predetermined and therefore every sequence can assimilate a predetermined number of pulses. If the pulse count reaches this predetermined number of pulses, the pulse density is at 100%. The figure shows that after a few cycles the detected pulses reach 100%, so the proper current value is reached after a few sequences. The inventive method has the advantage of a kind of a "soft start" of the driven LED's, because the LED's are started at a lower current than the nominal current and then the current is raised from sequence to sequence.

Figure 14:
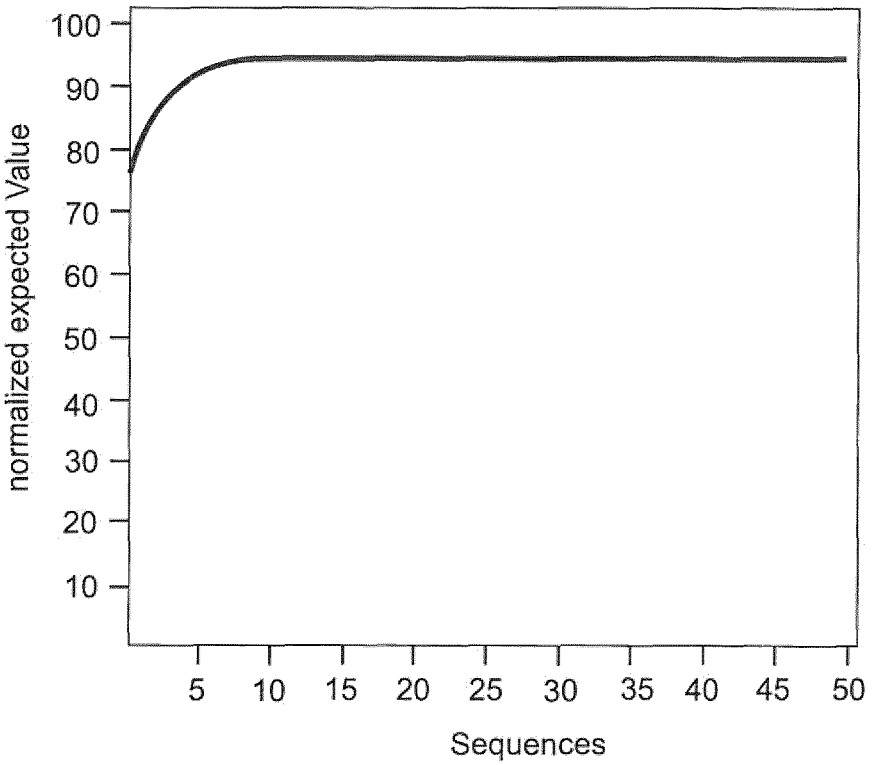
FIG. 14 shows a diagram of the detected pulses by the Power Supply Unit against the pulse sequences at a pulse density of 50%.

FIG. 14 shows a similar diagram than FIG. 13, so only the differences are explained. In FIG. 14, the pulse density is 50%, so a sequence includes half of the pulses it can handle. It can be seen, that after 15 to about 20 sequences, the proper current value is reached.

Figure 15:
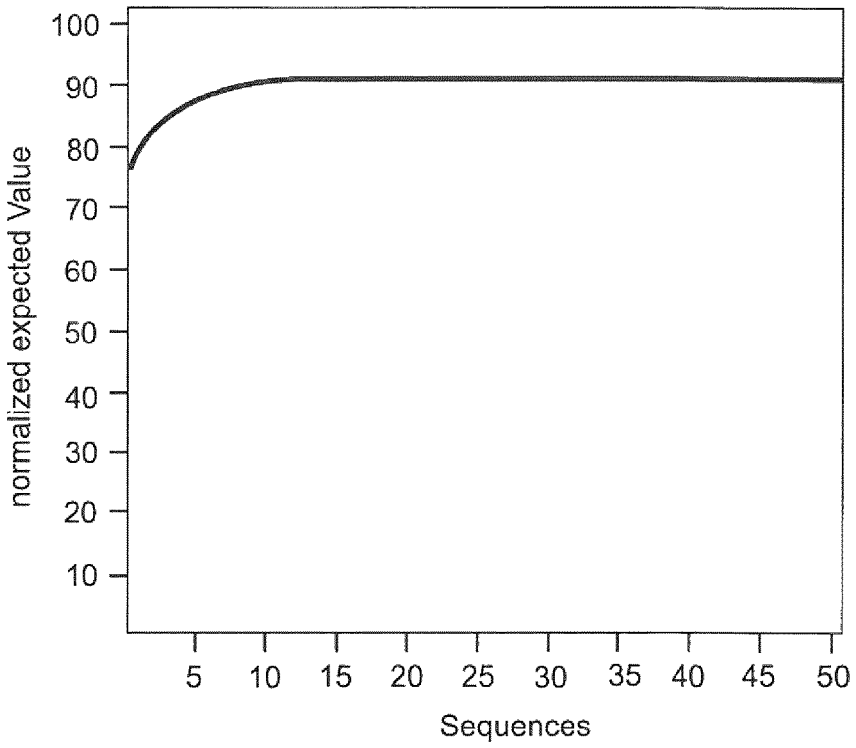
FIG. 15 shows a diagram of the detected pulses by the Power Supply Unit against the pulse sequences at a pulse density of 66%.

FIG. 15 shows a similar diagram than FIG. 13, so only the differences are explained. In FIG. 15, the pulse density is 66%, and this leads to a situation, where the proper current value is not reached anymore after 50 sequences. It takes much longer until the proper current value is reached. But as long as the pulse density is below 100%, the proper current value will be reached in finite time.

Figure 16:
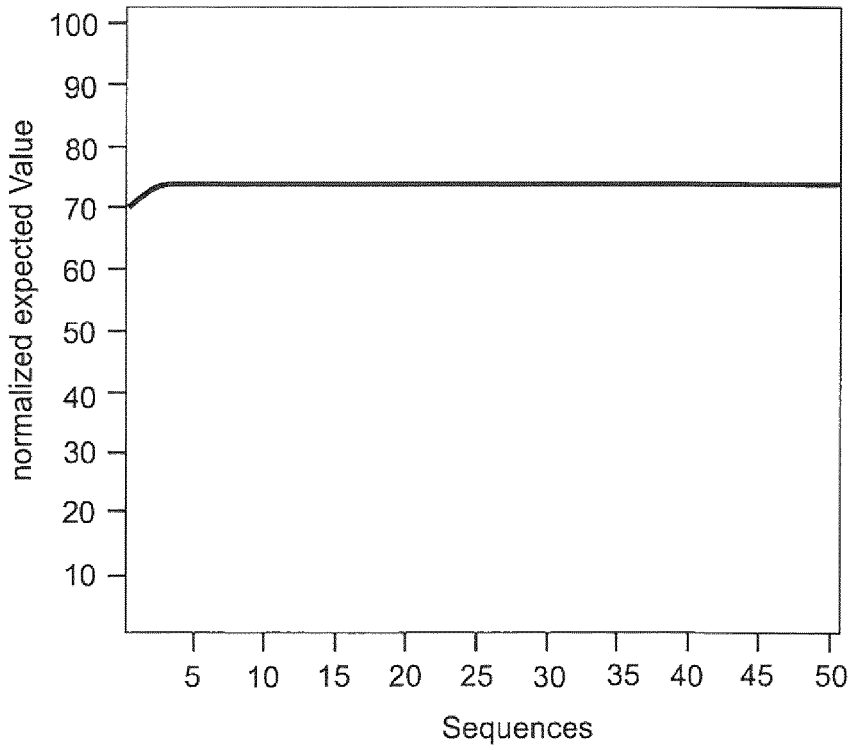
FIG. 16 shows a diagram of the detected pulses by the Power Supply Unit against the pulse sequences at a pulse density of over 100%.

FIG. 16 shows a similar diagram than FIG. 13, so only the differences are explained. In FIG. 16, the pulse density is over 100%, and this leads to a situation where the proper current value is not reached anymore. The method does not converge anymore. In this diagram, the current value converges at about 70% of the desired current value. But for practical reasons this is no problem as the Power Supply Unit principally cannot provide current values over 100% because in a practical embodiment 100% would be the highest current deliverable by the Power Supply Unit. In fact, as proven above a pulse density of over 50% leads to a quite long time until the proper current value is reached, one would for example define that at a pulse density of 50% the nominal power of the Power Supply Unit is reached.

The lighting system consisting of one Power Supply Unit and at least one Light Engine Module disclosed above has one disadvantage: The 'intelligence' is in the Light Engine Modules, the Power Supply Unit can be quite 'stupid' only counting pulses. This leads to high cost of the Light Engine Modules, while the Power Supply Units stay quite cheap regarding to the described interface. But much more Light Engine Modules are needed than Power Supply Units.

So in a second alternative of the second embodiment the 'intelligence' is transferred into the Power Supply Unit while the Light Engine Modules can be quite 'stupid'.

Figure 17:
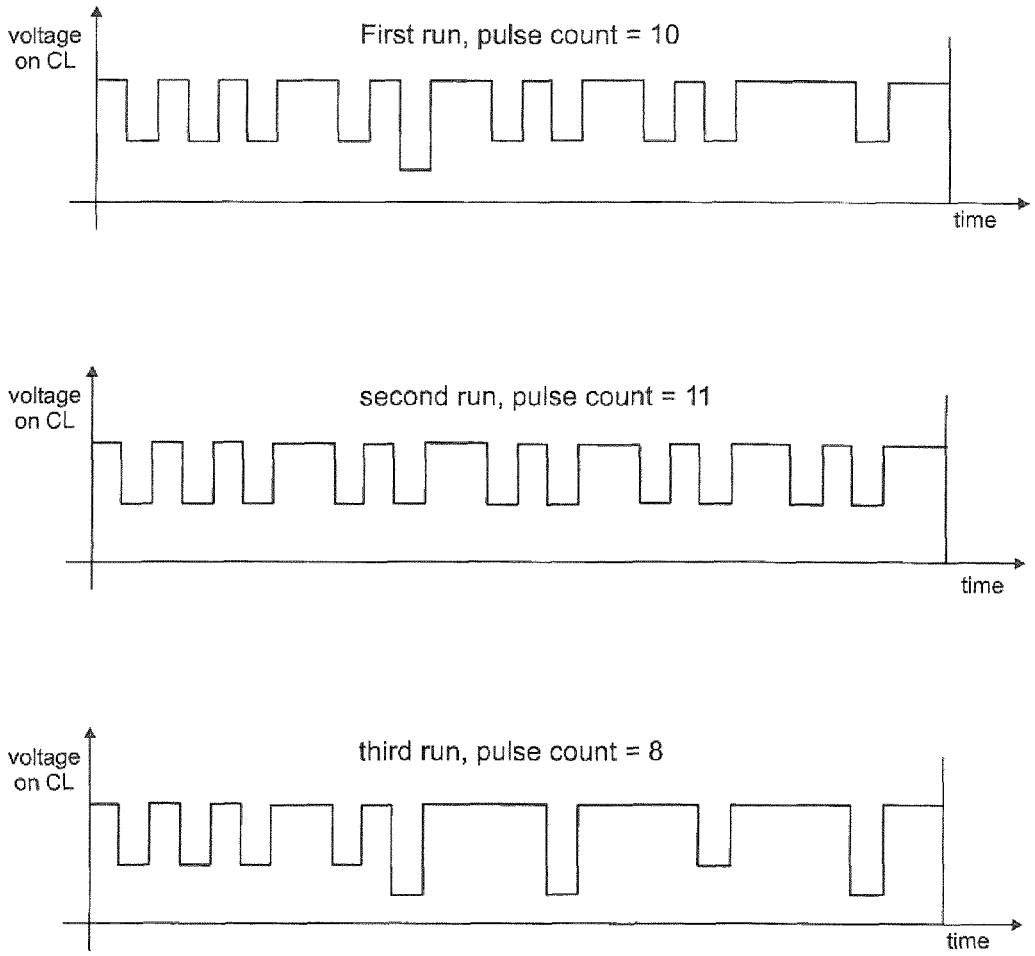
FIG. 17 shows an example of three successive sequences on the communication line CL with two Light Engine Modules connected to it.

FIG. 17 shows an example of three successive sequences on the communication line CL with two Light Engine Modules connected (as shown in FIG. 11C) to it. The main difference to the second alternative is that the Light Engine Modules do not fix their pulse distribution anymore. In every sequence, the pulse distribution of every Light Engine Module is generated by random. In FIG. 17 the real number of pulses communicated is 11 like in the above-second diagram.

The basic conditions are like in the first alternative of the second embodiment. The sequence length is fixed and predetermined, hence the number of pulses is also fixed and predetermined. Depending on the pulse density, a changing number of "double pulse events" occur. In the upper diagram, one "double pulse event" occurs, in the lowest diagram, three "double pulse events" occur. The Light Engine Module does not detect double pulse events anymore. The Light Engine Modules are quite 'stupid' in regard to the communication interface and only check the sequence start (the voltage on the communication line CL) and provide the correct number of pulses in a random pulse distribution sequence on the communication line CL. The Power Supply Unit detects the pulse number and is able to detect not only two but at least three states on the communication line CL: The logic low state, where the full voltage is measured on the communication line CL. The high state where a first fraction of the voltage is measured on communication line CL referring to a "single pulse event". And a "double pulse event" state where a second fraction is measured on communication line CL. As can be seen in FIG. 17, the second fraction is a lower voltage than the first fraction.

A "double pulse event" is not detected by the Light Engine Modules and therefore they do not react on such events. This leads to the conclusion, that the lowest possible value measured by a digital detection circuit with only "high" and "low" is the highest number of pulses provided by one Light Engine Module. The longer the predetermined duration of a sequence is the lower is the probability of "double pulse events". As the pulse distribution is generated by random, the value of the pulse count will also be a statistical value. This leads to the conclusion that corrective actions can be taken to improve the value measured by the Power Supply Unit. The Power Supply Unit is able to measure not only the number of pulses, but also the number of "double pulse events", hence the number of collisions. This can be used in corrective action.

Figure 18:
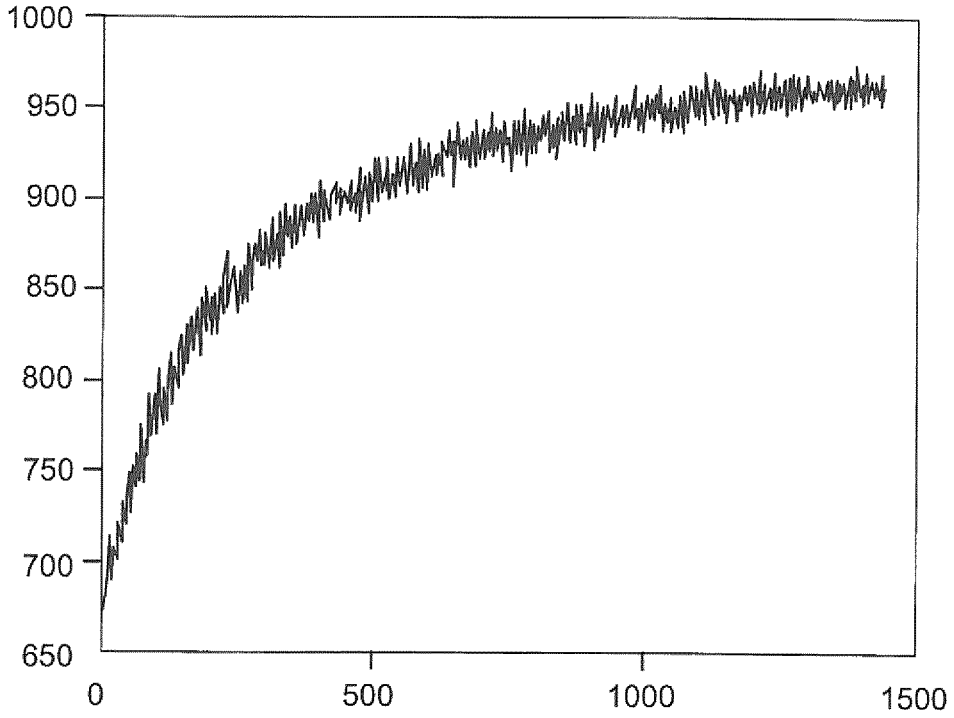
FIG. 18 shows an example of the normalized pulse count against the sequences for a setup with five connected light engines.

FIG. 18 shows an example of the normalized pulse count (per mil) against the sequences for a setup with five connected light engines.

The current requirements of the light engines are as follows:

Light Engine 1: 32 Pulses
Light Engine 2: 64 Pulses
Light Engine 3: 16 Pulses
Light Engine 4: 32 Pulses
Light Engine 5: 16 Pulses The overall value of pulses is 160, relating to 1000 per mill in the diagram.

At a pulse density of 33% and an average over 100 sequences the Power Supply Unit counts about 96.5% of the real value of sent pulses. This means that −154 of the 160 pulses are recognized. It can be seen that at the pulse density of 33% about 96.5% of the pulses are count. This means that 3.5% of the pulses are "double pulse events" or events with even more pulses (up to 5 as there are 5 Light Engine Modules connected). So without corrective actions, the error made in current control is 3.5%.

To improve the error rate, the inventive method proposes to establish a corrective Factor k. The corrective Factor k is calculated out of the collision density, that means the density of "double pulse events". This does mean the number of "double pulse events" divided through the number of pulses a sequence can assimilate. 100% collision density means that every second place in a sequence is occupied by a pulse collision. As has been said above, the length of a sequence is predetermined and therefore every sequence can assimilate a predetermined number of pulses. If the collision count reaches, for example, half of this predetermined number of pulses (as every collision incorporates at least 2 pulses), the collision density k is at 100%. The pulse sum recognized by the Power Supply Unit is multiplied by 1+k:

$$\text{correctedvalue}=\text{recognizedpulses}\cdot(1+k);$$

K is the collision density, so if k is at 50%, pulse sum is multiplied by 1.5.

The advantage of this calculation is if only one Light Engine Module is connected, the corrected value will never be greater than the pulse sum.

Figure 19:
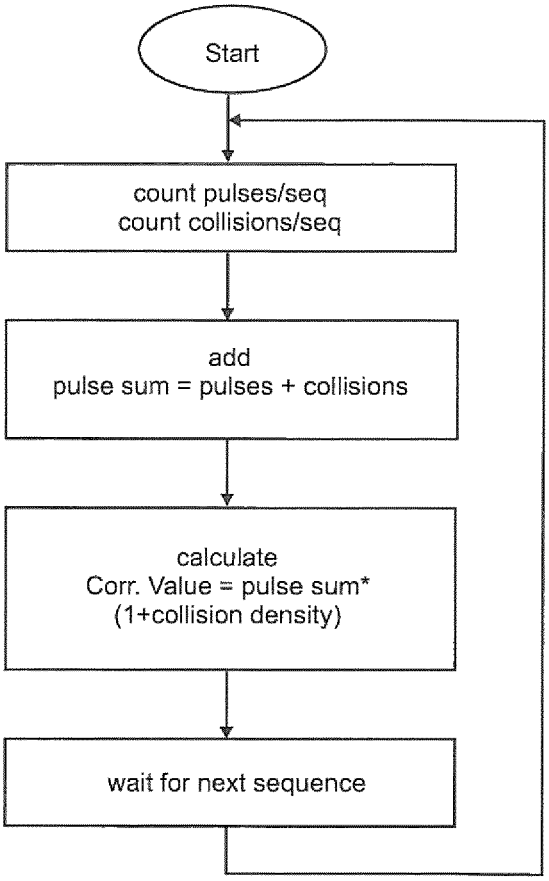
FIG. 19 shows a flow chart of the method conducted by the Power Supply Unit PSU.

FIG. 19 shows a flow chart of the method conducted by the Power Supply Unit PSU. The Power Supply Unit counts the pulses and the collisions ("double pulse events") in a sequence. At the end of the sequence, the pulses and collisions are added together to get the pulse sum. The correction factor k is calculated out of the collision density. The corrected value is calculated out of the pulse sum and the collision density due to the Formula:

$$\text{correctedvalue}=\text{recognizedpulses}\cdot(1+k).$$

Then the sync signal of the next sequence is awaited.

Figure 20:
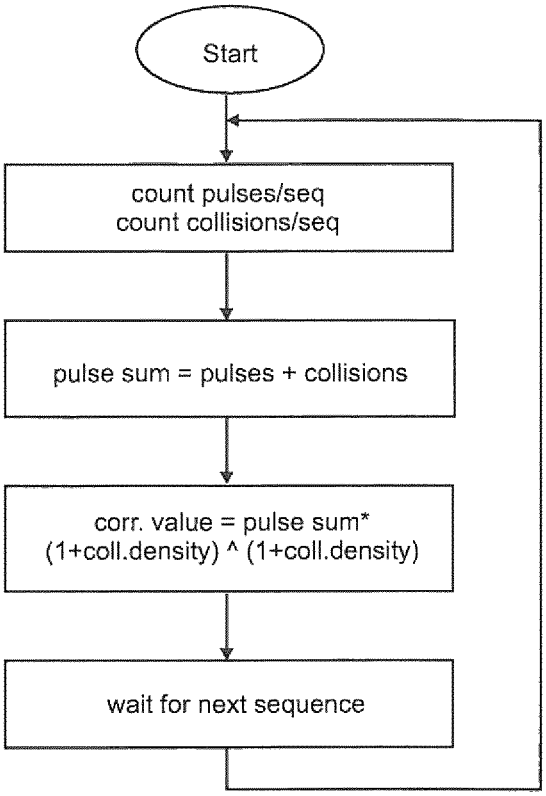
FIG. 20 shows a flow chart of the method conducted by the Power Supply Unit PSU.

FIG. 20 shows a flow chart of an improved method conducted by the Power Supply Unit PSU. It has astonishingly been found that a simple equation can improve the error significantly. The pulse sum of the recognized pulses is multiplied by a correction factor calculated out of the pulse density and raised to itself power. The pulse density equation reads as follows:

$$\text{correctedvalue}=\text{recognizedpulses}\cdot(1+k)$$

With this simple equation the normalized pulse value converges to 1 much faster than with the above mentioned corrective action.

Generally, it can be said, that for every method to count the pulses a proper equation can be found to correct the counted pulses to a value providing nearly no error in respect to the real value.

This is done by setting up the method collisions are counted and doing a statistical analysis with this method to generate the matching equation to the pulse-count-method. It is stressed that it need not always be the power of the pulse density to match. A simple factor can also help to reduce the error significantly.

Figure 21:
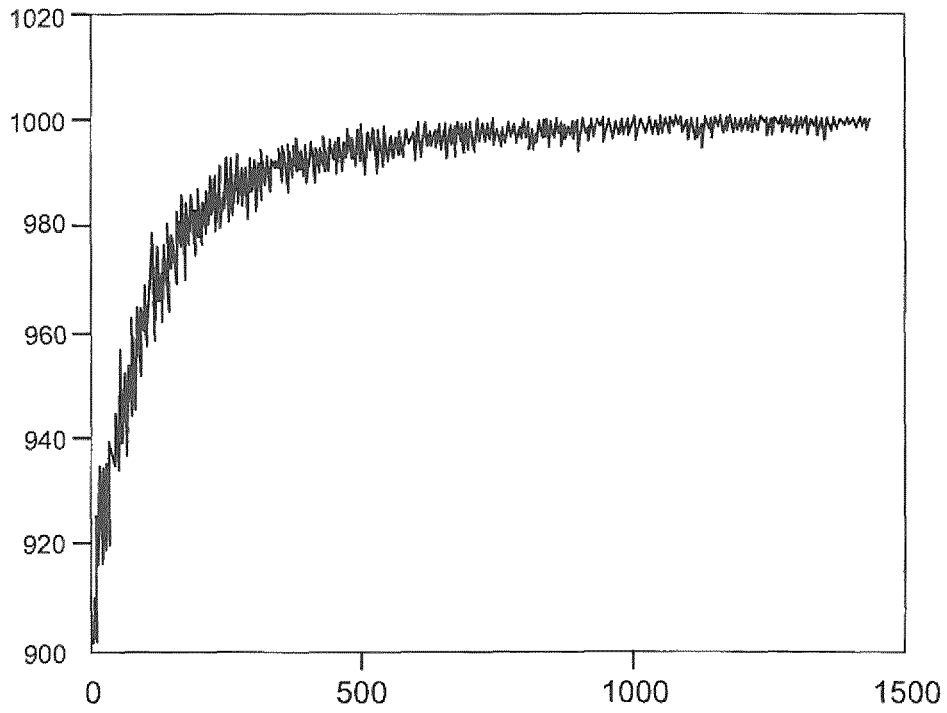
FIG. 21 shows the normalized pulse value for an example with 5 Light Engine Modules and the method of FIG. 20.

FIG. 21 shows the normalized pulse value for the same example with 5 Light Engine Modules and the method of FIG. 20. With this method the normalized pulse value converges to 1 very quickly. This means that every pulse sent is counted and the correct current value is provided by the Power Supply Unit PSU.

In a third alternative of the second embodiment another method is proposed. The method of the third alternative is directed to a continuous stream of pulses to adjust the supply current by the Power Supply Unit. The Light Engine Modules do not wait for a sync signal from the Power Supply Unit, but send their pulses representing the current demand in a continuous fashion. The Power Supply Unit only counts the pulses per time unit and adjusts the power accordingly. To minimize the problem of double pulse events, or in other words to minimize the collisions, a Jitter is added to the Frequency of every Light Engine Module so it is as unlikely as possible that 2 pulses are sent at the same time. To improve this behaviour, a minimal and a maximal frequency for the Light Engine Modules can be defined, so the probability of collisions will fall even more.

The Power Supply Unit PSU integrates the pulses over time and calculates a mean value of the current demand. Preferably, the integration time is long enough to incorporate possible beat frequencies and eliminate the current deviation through the integration. The definition of a minimal and a maximal frequency for the Light Engine Modules also helps to increase the beat frequencies and minimize the probability that those beat frequencies can be recognized by the human eye.

For start-up, the integration time can be set very short and can be lengthened as time goes by. This adds a desired feature of a soft start, as the pulses counted right after start-up will be less than after integration over time. So at start-up, the current is small and increasing over the integration time leading to a soft start of the connected Light Engine Modules.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

REFERENCE CHARACTER LIST

PSU Power Supply Unit
LEM Light Engine Module
CMU Current Measurement Unit
TDU Temperature Derating Unit
PGU Pulse Generation Unit
PG Pulse Generator
CL communication line
CG Current Generator
Vout internal measurement signal
Rset current set resistor
Rthr threshold set resistor
Rtg emitter resistor
Rfb current measurement resistor
Rp Pulse Resistor
LED+ positive power supply line
LED− common ground line
V1 voltage source
Vk voltage source
Vout internal measurement signal
S pulse switch

The invention claimed is:

1. A Power Supply Unit comprising:
an output providing electrical power between a positive power supply line and a
common ground line,
a communication line where signals on the communication line are measured against the common ground line,
an adjustable current generator responsive to an internal measurement signal generating an output current at the output,
a switchable voltage source coupled to the communication line,
a measurement unit capable of measuring different voltage levels on the communication line, and
a Central Processing Unit which inputs information from the measurement unit and outputs instructions to the switchable voltage Source and the adjustable current generator.

2. The Power Supply Unit according to claim 1, wherein the measurement unit is capable of distinguishing between three different voltages on the communication line.

3. A method of driving a Light Engine Module with a Power Supply Unit,
the Light Engine Module comprising:
a plurality of series connected LEDs,
a positive power supply line,
a common ground line,
a communication line where signals on the communication line are measured against the common ground line, and
a Pulse Generation Unit generating pulses with its number proportional to
the current demand of the Light Engine Module,
the Power Supply Unit comprising:
an output providing electrical power between a positive power supply line and a common ground line,
a communication line where signals on the communication line are measured against the common ground line,
an adjustable current generator responsive to an internal measurement signal generating an output current at the output,
a switchable voltage source coupled to the communication line,
a measurement unit capable of measuring different voltage levels on the communication line, and
a Central Processing Unit which inputs information from the measurement unit and outputs instructions to the switchable voltage Source and the adjustable current generator,
the method comprising:

sending from the Power Supply Unit a synchronisation signal to the communication line to start a pulse sequence;

sending from every Light Engine Module a number of pulses corresponding to its current demand by shorting the communication line via a resistor;

counting at the Power Supply Unit the pulses on the communication Line by measuring the voltage on the communication line; and adjusting at the Power Supply Unit the adjustable current source in respect to the counted pulses.

4. The method according to claim 3 wherein after every pulse a pulse pause is situated.

5. The method according to claim 3 wherein the duration of the pulse sequence is long compared to the number of pulses sent.

6. The method according to claim 3, wherein every pulse sequence has a predetermined number of pulses where every pulse has a place within the pulse sequence.

7. The method according to claim 3, wherein after every pulse sequence a stop signal is sent by the Power Supply Unit.

8. The method according to claim 3, wherein the initial pulse distribution of the pulse sequence sent by the Light Engine Modules is generated by random.

9. The method according to claim 3, wherein the Light Engine Module is capable of measuring a collision event when more than one Light Engine Module sends a pulse at the same time.

10. The method according to claim 9, wherein the Light Engine Module erases the pulse at the place where the collision event occurred and displaces it to another place within the sequence by random.

11. The method according to claim 3, wherein the measurement unit of the Power Supply Unit is capable of measuring a collision event when more than one Light Engine Module sends a pulse at the same time.

12. The method according to claim 11, wherein the central processing unit of the Power Supply Unit counts the pulses and the collision events, adds them together to the recognized pulses, calculates a corrected value with this recognized pulses and a collision density, and adjusts the adjustable current source according to the corrected value.

13. The method according to claim 12, wherein the corrected value is calculated by multiplying the recognized pulses with a factor calculated with the collision density raised to the power of itself.

14. The method according to claim 13, wherein the corrected value is calculated according to the formula: $\text{correctedvalue} = \text{recognizedpulses} \cdot (1+k)^{(1+k)}$.

15. The method according to claim 3, wherein the voltage of the communication line is measured against common ground.

* * * * *